United States Patent [19]

Detert et al.

[11] 4,247,349

[45] Jan. 27, 1981

[54] METHOD AND APPARATUS FOR CUTTING PLASTIC FILM WINDOWS FOR CARTONS

[75] Inventors: Robert M. Detert, Menasha; Hubert J. Germiat; William M. Kelly, Jr., both of Appleton, all of Wis.

[73] Assignee: American Can Company, Greenwich, Conn.

[21] Appl. No.: 38,568

[22] Filed: May 14, 1979

[51] Int. Cl.[3] ..... B31B 1/24; B31B 1/82

[52] U.S. Cl. ..... 156/108; 156/252; 156/257; 156/497; 156/513; 156/521; 493/344; 493/369; 493/393; 493/905

[58] Field of Search ..... 156/108, 250, 252, 264, 156/510, 514, 521, 257, 497, 513, 568; 93/61 A, 58.2 R, 62

[56] References Cited

U.S. PATENT DOCUMENTS

| | | | |
|---|---|---|---|
| 3,475,252 | 10/1969 | White | 156/510 X |
| 3,516,891 | 6/1970 | Hubin | 156/521 |
| 3,654,038 | 4/1972 | Hottendorf | 156/521 |
| 3,744,384 | 7/1973 | Jarritt et al. | 93/58.2 R |
| 3,749,626 | 7/1973 | Buck | 156/510 X |
| 3,878,771 | 4/1975 | Malcolm | 156/521 X |

*Primary Examiner*—Michael G. Wityshyn

*Attorney, Agent, or Firm*—Robert P. Auber; Ernestine C. Bartlett; Harry C. Engstrom

[57] ABSTRACT

Panels of plastic film are delivered to a perforated vacuum drum which has a knife edged die mounted on its surface. Each panel is laid over the die and rotates with the drum into rolling contact with an anvil roll which firmly presses the film panel against the knife edge to cut the panel. After cutting, the film panel continues to rotate with the drum to a position wherein it registers with a blank having a cut-out opening therein which is covered by the film panel. The areas of the blank surrounding the cut-out opening are covered with an adhesive material which causes the film panel to remain adhered to the blank. The vacuum drum continues to rotate and, after bonding of the panel to the blank, the drum releases the vacuum draw on the panel. The cuts formed in the plastic film panels can be straight lines, lines of perforations, or cut-outs bounding areas which are removed from the panel.

10 Claims, 7 Drawing Figures

METHOD AND APPARATUS FOR CUTTING PLASTIC FILM WINDOWS FOR CARTONS

BACKGROUND OF THE INVENTION

1. Field of the Invention.

This invention pertains generally to the field of machines for assembling cartons, and more particularly to apparatus which applies plastic film panels to carton blanks which have cut-out "windows" formed in them which are covered by the film panels.

2. Description of the Prior Art

Tissue dispensing cartons often have a cut-out opening in them which is covered by plastic film. A cut or cut-out portion of the film allows the user to reach through and pull out a single tissue at a time. The cut plastic window has the advantage of allowing the user to see the contents of the carton, while providing a resilient and flexible material which can hold the next tissue to be dispensed in a position above the top of the box so that it is easily reached by the user.

The plastic film is typically provided from a continuous roll with cuts or slits being formed in spaced relation in a continuous sheet drawn from the roll. After cutting, the continuous sheet of film is then delivered to apparatus which cuts the sheet to form appropriately sized panels and then delivers the panels to a position where they are adhered to the carton blanks. However, thin plastic films are difficult to handle or rewind into a roll after cutting of slits or openings without stretching, buckling or tearing of the film. As an alternative to cutting the film first, the uncut film panels have been applied to the carton blanks and the completed unit has then been fed to a mechanism which makes the appropriate cut in the plastic window. Two separate operations are again required, the adhering of appropriately sized panels to the carton blank and the subsequent cutting of the window in the blank.

A typical windowing machine includes a large vacuum drum which has a perforated surface. The proper width of the plastic film is usually supplied from a large roll of film, is cut to length by a rotary knife cylinder which mates with an anvil on the vacuum drum, and is held in position by vacuum draw through the drum perforations as a result of vacuum applied to the interior of the drum. A timed feeding device delivers flat blanks or cartons through a glue application station where adhesive is applied in a pre-determined pattern generally surrounding the cut-out opening or window in the carton. The carton is delivered to a nip formed between the vacuum drum and a back-up nip roll such that the precut plastic film panel registers to cover the cut-out opening in the blank. An internal manifold arrangement within the drum releases the vacuum from the film as it passes out of the nip, thereby allowing the film to remain adhered to the blank without interference.

SUMMARY OF THE INVENTION

The apparatus of the invention utilizes a vacuum drum to perform both the step of adhering the plastic film panel to carton blanks, and additionally the step of cutting the plastic panel in the desired pattern. The film panel is cut as it is held by vacuum on the vacuum drum so that no pulling or other lateral forces are applied to the panel, which thus avoids any stretching or buckling of the cut panel.

The cutting of the film panel is accomplished on the vacuum drum so that the processing time required is the same as that previously used for the step of adhering the film panel to the carton blank. The apparatus and method of the invention thus has the advantage of reducing the overall processing time, as well as eliminating the requirement for the additional complex machinery ordinarily required to handle either pre-cut plastic film panels or blanks with windows in them which must be subsequently cut.

The apparatus includes a knife edged die which is mounted on the surface of the drum and protrudes slightly above the surface. Plastic film panels are cut to size and laid over the knife edged die on the drum, and are thereafter held against the surface of the drum by the vacuum draw. A hard surfaced anvil roll is mounted for rotation with the surface of the vacuum drum such that the film panel is firmly pressed between the hard surface of the anvil roll and the knife edge of the die so that the film is cut in the pattern formed by the knife edge. After passing out of contact with the anvil roll, the cut film continues to rotate with the drum until it comes into position to register with a blank having adhesive applied to the surfaces thereof surrounding the window in the blank.

The anvil roll is preferably pivotably mounted to be driven toward contact with the surface of the vacuum drum by an air cylinder. Resilient rubber drive rings on the edges of the anvil roll make contact with the surface of the vacuum drum to drive the anvil roll with the drum, while maintaining the surface of the anvil roll slightly away from the surface of the drum. Ramp shaped shims may be mounted on the surface of the vacuum drum in a position leading the knife edged die, so as to make smooth contact with the anvil roll and elevate it to a position such that the roll makes smooth initial contact with the leading edge of the knife edged die.

The die itself may comprise a straight line, a curved line which bounds an area of the panel which may be completely removed, or the die knife edge may be serrated so as to provide a perforation of the film panel.

Further objects, features, and advantages of the invention will be apparent from the following detailed description taken in conjunction with the accompanying drawings.

DESCRIPTION OF THE PREFERRED EMBODIMENTS

Figure 1:
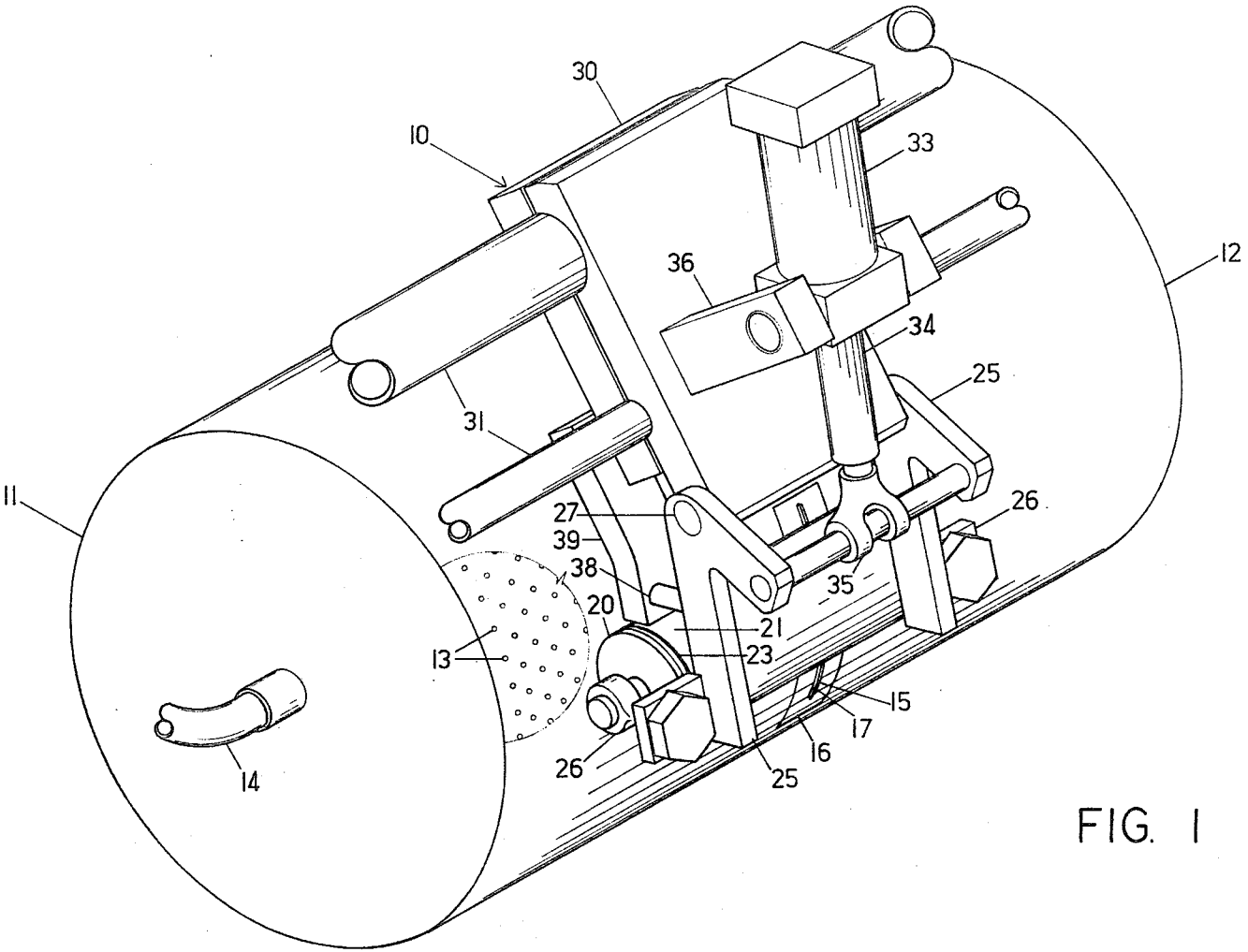
FIG. 1 is a perspective view of the apparatus of the invention shown cutting a slit in a plastic film panel.

With reference to the drawings, a preferred embodiment of apparatus for cutting plastic film window panels for cartons is shown generally at 10 in FIG. 1. The apparatus 10 employs a standard vacuum drum 11 which is mounted for rotation about a horizontal axis. The surface 12 of the vacuum drum has a plurality of perforations 13 formed therein, and the interior of the vacuum drum is partially hollow and in communication with the perforations. A vacuum line 14 is connected to communicate with the interior of the vacuum drum so as to provide a vacuum draw through the perforations 13. As a result of this vacuum action, any panels of plastic film which are laid on the surface of the vacuum drum will be firmly held to the surface even though the drum is rotating at fairly high speed.

A knife edged die 15 is mounted to the surface of the vacuum drum such that the knife edge of the die protrudes slightly above the drum surface. For purposes of illustration, a plastic film panel 16 has been shown laid over the knife edge die 15. The film panels 16 are provided from a continuous roll of film which is cut to proper size to form each of the individual panels 6. It will be apparent that panels of material other than plastic, such as paper or metal foil, can be similarly cut in accordance with the present invention. In the present invention, standard apparatus is utilized to cut the panels to size and lay them over the knife edged die 15 in proper position on the rotating drum, with this standard feeding apparatus not being shown in FIG. 1 for purposes of simplification.

Figure 3:
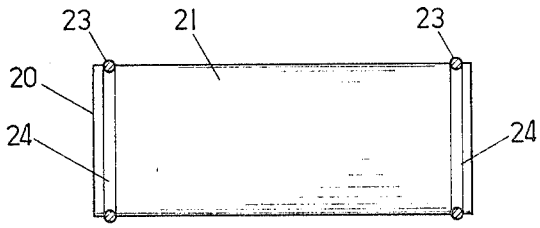
FIG. 3 is a front elevation view of the anvil roll portion of the apparatus.

A hard surfaced cylindrical anvil roll 20 rotates along the surface 12 of the vacuum drum in position to press each plastic film panel 16 between the surface 21 of the anvil roll and the knife edge 17 of the die 15. The anvil roll surface is preferably formed of hardened steel so as to provide an unyielding backup surface to the knife edge. A pair of resilient elastomer drive rings 23 are mounted in grooves 24 in the surface 21 of the anvil roll near the outer edges of the roll. As best shown in FIG. 3, the drive rings extend slightly above the surface of the anvil roll and engage the surface 12 of the vacuum drive to firmly drive the anvil roll in rotation with the surface of the vacuum drum, and also to space the surface of the anvil roll slightly above the surface of the drum.

The anvil roll is mounted for rotation to a pair of pivot arms 25. The anvil roll 20 is journaled to end brackets 26 mounted on the ends of the pivot arms 25 so that the anvil roll can rotate freely and be driven by the rotation of the surface 12 of the vacuum drum. The pivot arms are themselves journaled for rotation to a pivot shaft 27 attached to a mounting frame 30 which is adapted to be rigidly mounted on available portions of auxiliary equipment, such as the vacuum pipes shown for illustration at 31.

The mounting of the pivot arms 25 about the pivot shaft 27 allows the anvil roll 20 to be rotated into and out of engagement with the surface of the vacuum drum 12. In the arrangement shown in FIG. 1, the force of gravity will cause the anvil roll to rotate into contact with the drum. However, it is highly desirable to selectively rotate the anvil roll into and out of engagement, and to apply varying pressures to the anvil roll against the surface of the drum depending on the height of the knife edged die, the thickness and toughness of the plastic films to be cut, and other considerations. To selectively move the anvil roll into and out of engagement with the vacuum drum, an air pressure powered drive cylinder 33 is utilized with the drive rod 34 of the drive cylinder attached through a clevis linkage 35 to the pivot arms 25. The base of the drive cylinder 33 is connected by a pivot mount 36 to the mounting frame 30. The drive cylinder 33 is selectively supplied with air under pressure from a controllable source (not shown) so that it drives the anvil roll 20 into contact with the vacuum drum when supplied with air under pressure in one direction, and retracts the anvil roll from the vacuum drum when supplied with air under pressure in the opposite direction. By controlling the pressure of the air pressure supplied to the drive cylinder, the pressure that the anvil roll applies to the knife edge of the die can be varied.

Additional control of the positioning of the anvil roll is provided by means of a detent stop screw 38 which is threaded through a detent bracket 39 and makes contact at its end with the face of one of the pivot arms 25. The detent stop screw 38 can be adjusted by the operator of the apparatus so that one end of the anvil roll is held at a precise distance away from the surface of the vacuum drum, regardless of the pressure applied by the air cylinder 33. The screw 38 thereby provides a means for aligning the anvil roll surface precisely parallel to the drum surface, if so desired.

Figure 2:
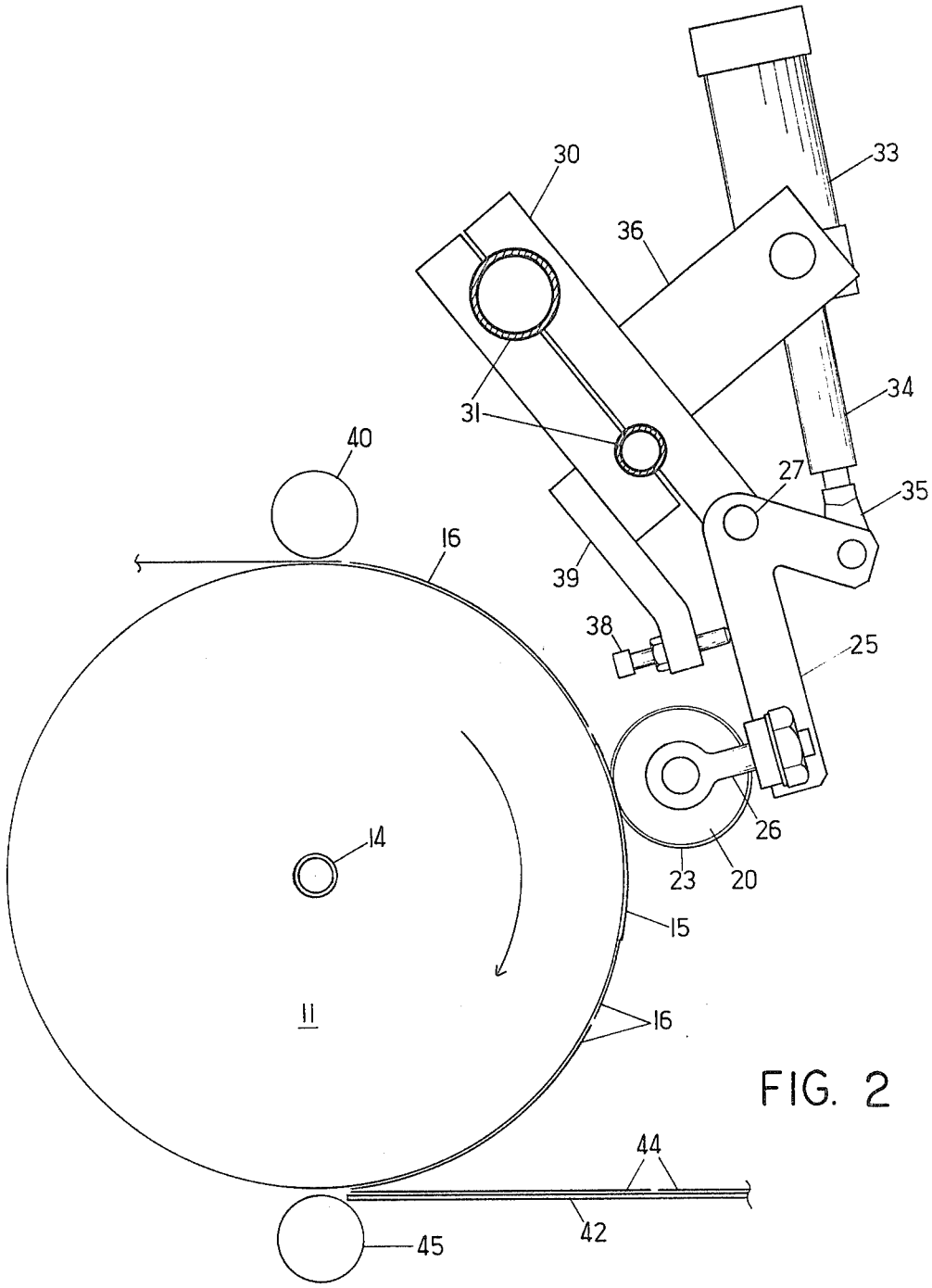
FIG. 2 is a somewhat simplified side elevation view of the apparatus of the invention.

The operation of the apparatus is best shown with reference to the side view of FIG. 2, which also shows in schematic form a plastic film panel cutting and feeding station 40 and a conveyor 42 which delivers a series of paperboard blanks 44 in spaced relation to a position at the bottom of the vacuum drum 11. The details of the feeding station 40 and the conveyor 42 are not shown, since these are of standard construction in such devices. It is understood that the feeding conveyor 42 also includes an adhesive application station (not shown) which applies adhesive to an area of each carton blank 44 surrounding the cut-out opening in the carton blank which the plastic film panels are to cover. The conveyor 42 delivers the adhesive coated carton blanks to a nip formed between the surface of the vacuum drum and a back up roller 45 in synchrony with the rotation of the surface of the vacuum drum so that the plastic film panels register properly to cover the cut-out openings in the carton blanks. The pressure applied at the nip between the back up roller 45 and the vacuum drum 11 is sufficient to firmly adhere the plastic film panels to the carton blanks. Internal ducting within the vacuum drum 11 cuts off the vacuum to the surface of the vacuum drum at the bottom of the drum so that the plastic film panels are released from the drum after they have been adhered to the carton blanks 44.

Only one knife edged die 15 is shown for purposes of illustration on the surface of the drum 11 in FIG. 2, but it should be understood that a series of such knives would be mounted on the surface of the drum 11 so as to underlie each successive film panel 16 which is laid on the surface of the drum by the feeding apparatus 40. Rotation of the drum brings each of the film panels into a position wherein they are engaged between the knife edged die 15 and the hard surface of the anvil roll, thereby cutting the film panel in the pattern defined by the edge of the die. Since the film panel is held firmly to the surface of the vacuum drum by the vacuum force which is directed entirely radially inwardly, no lateral forces are exerted on the cut film panels such as would tend to distort or tear the film before it is applied to the carton blank 44.

It should be understood that film panels can be similarly applied to carton blanks which do not have cut-out openings in them. For example, in some tissue cartons, a perforated tear strip is provided in the carton and is removed by the user to expose the plastic film panel underneath.

Figure 4:
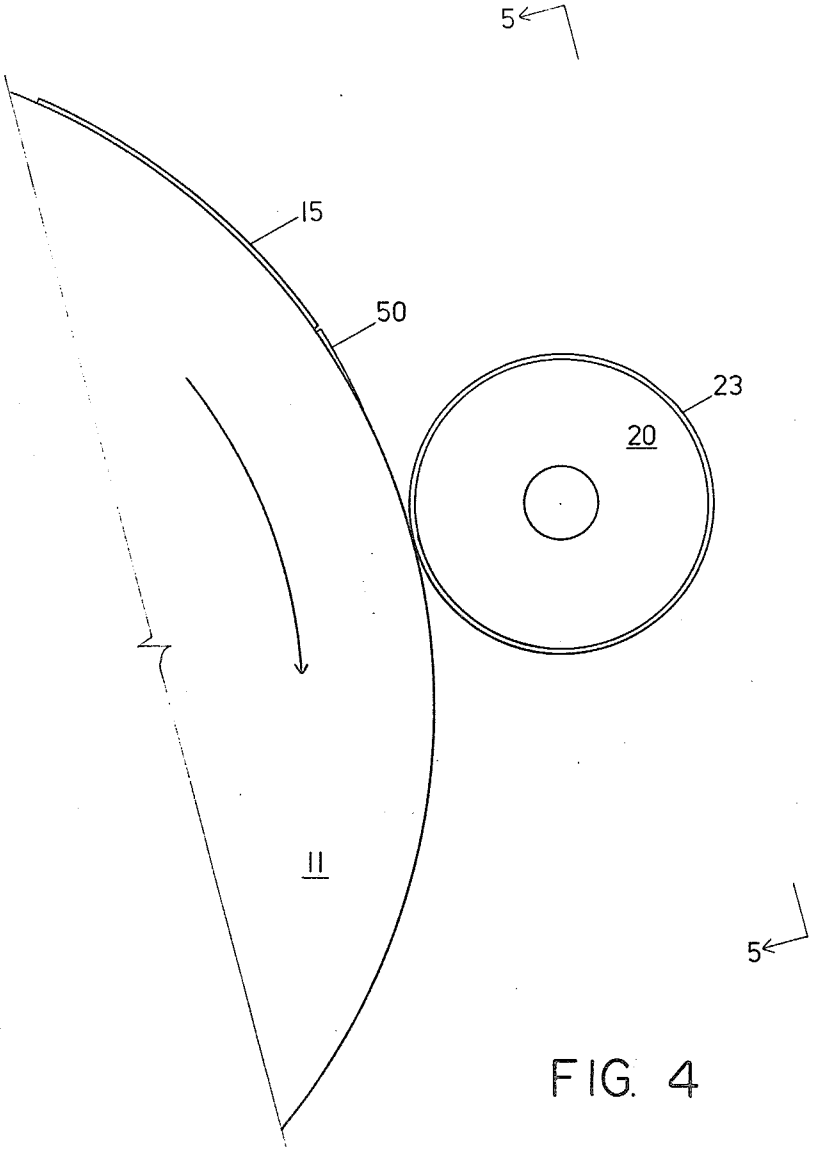
FIG. 4 is a somewhat simplified side elevation view of a modification of the apparatus utilizing shim ramps to provide smooth engagement of the anvil roll with the cutting knife.

A modification of the apparatus of the invention is shown in the somewhat simplified schematic side view of FIG. 4. In order to minimize the initial shock of contact between the hard surface anvil roll and the leading edge of the knife edged die 15, a pair of thin metal shim ramps 50 are mounted to the surface of the vacuum drum 11 in a position on the drum which leads the position of the knife edge 15 in the direction of rotation of the drum. As best shown in the front elevation view of FIG. 5, the ramps 50 are mounted on either side of the position of the plastic film panel 16 as it is laid over the knife edged die 15. However, the ramps 50 are spaced inwardly of the position at which the rubber drive rings 23 of the anvil roll contact the surface 12 of the vacuum drum. Since the anvil roll must, of necessity, press firmly against the knife edge 15 in order to make a proper cut in the plastic film, the initial position of the bottom tangent of the anvil roll adjacent to the surface 12 of the drum will be below the top surface of the knife edge of the die 15. As a result, the surface of the anvil roll will ordinarily slam into the leading point of the knife edged die 15 with sufficient force to dull the edge of the knife over a period of time. The provision of the shim ramps 50 serves to minimize the shock as the anvil roll first engages the knife edge.

The shim ramps 30 are very thin pieces of metal which are adhered with adhesive to the surface of the vacuum drum, and have a leading edge which is very thin so as to be less than the height at which the anvil roll is normally riding above the surface of the vacuum drum. The ramps are wedge-shaped and extend upwardly from their leading edge to a trailing edge which is substantially at the height of the knife edge 15. The trailing edge of the ramps are preferably positioned as shown, substantially adjacent to, but slightly ahead of the leading edge of the knife edged die. The ramps serve to gradually elevate the anvil roll above the surface of the drum to substantially the height of the knife edge, and thereafter release the anvil roll onto the surface of the knife edge in a smooth transition.

Figure 5:
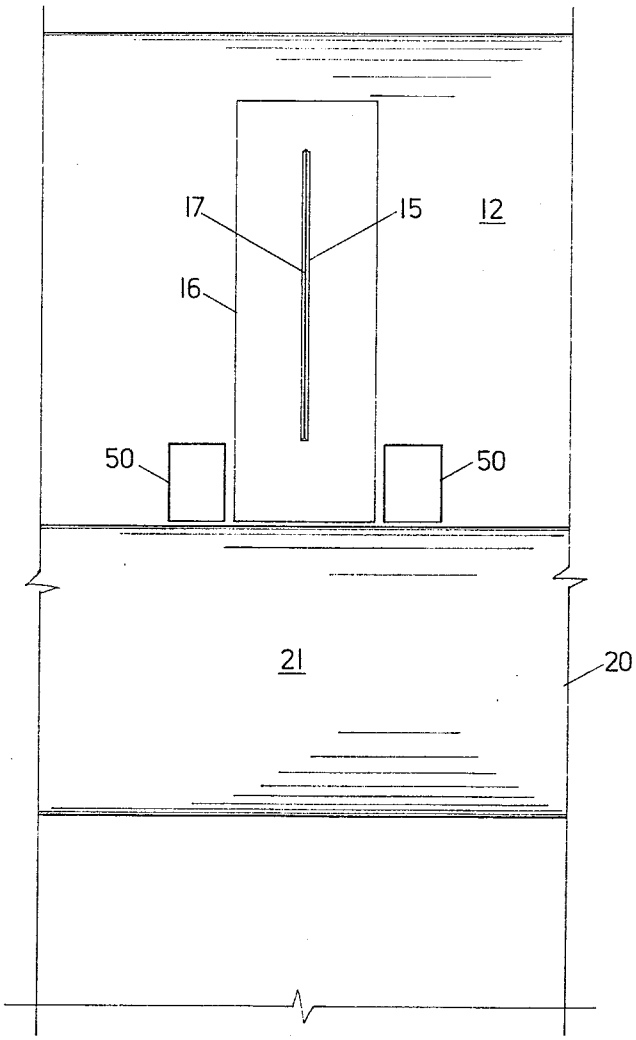
FIG. 5 is a somewhat simplified front elevation view of the apparatus shown in FIG. 4.
Figure 6:
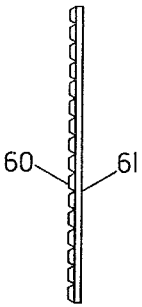
FIG. 6 is a side elevation view of a serrated knife edged die.
Figure 7:
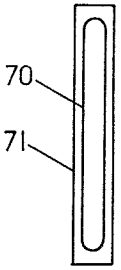
FIG. 7 is a plan view of a knife edged die wherein the knife edge defines a closed figure.

The knife edge 17 of the die 15 shown in FIGS. 4 and 5 comprises a straight line edge lying in the circumferential direction of drum rotation, such as would be desired for cutting a single slit in a plastic panel. Such single slits are utilized for tissue dispensing type cartons such that the user can reach through the slit to pull out a single tissue, with trailing tissues being held for ready access in the slit. The knife edged dies 15 are typically produced by chemically etching a strip of metal so as to provide a one piece die which consists of the protruding knife edge integrally connected to a relatively thin base forming a metal strip which can be adhered with a strong adhesive to the surface of the vacuum drum. However, it should be noted that other knife edge configurations may be utilized with equal efficacy. For example, the edge 60 of a die 61 as shown in FIG. 6 may be serrated so that contact of the anvil roll with the edge of the die forms a perforated cut in the film panel. As another example, the edge 70 of a die 71 as shown in FIG. 7 may describe a closed figure which bounds an area of the film panel which is to be cut out and completely separated from the remainder of the panel. After the film panel has been cut, the cut out portion may be removed by various means, such as a vacuum nozzle (not shown) applied adjacent to the surface of the vacuum drum which pulls out the cut out portion of the film panel, or the cut out portions may be removed after the film panels have been adhered to the carton blanks.

It is understood that the invention is not confined to the particular construction and arrangement of parts herein illustrated and described, but embraces all such modified forms thereof as come within the scope of the following claims.

We claim:

1. Improved apparatus for mounting plastic film windows on cut-out carton blanks, of the type having a perforated surfaced vacuum drum, a film panel feeding station for laying film panels individually on the surface of the vacuum drum whereupon they are held to the drum surface by vacuum suction, a carton blank feeding conveyor which delivers adhesive coated carton blanks to a position adjacent to the vacuum drum in registry with film panels on the vacuum drum, whereupon the film panels are released from the vacuum drum and remain adhered to the carton blank, the improvement comprising:

(a) a knife edged die mounted to and protruding above the surface of said drum which is adapted to cut each individual film panel laid over said die in a pattern defined by the knife edge of said die;

(b) an anvil roll having a cylindrical surface;

(c) means for mounting said anvil roll for rotation with the surface of said vacuum drum and for urging said anvil roll toward said drum surface such that the surface of said anvil roll makes firm rolling contact with the knife edge of said knife edged die, whereby plastic film panels fed to the surface of said drum to lie over said die will be held firmly over the same by the vacuum suction applied to the perforations on said drum surface, and, as said drum rotates, the panels will be cut at the knife edge of said die in the pattern of the knife edge as the film panel is engaged between said die and said anvil roll.

2. The apparatus of claim 1 wherein said die has a straight knife edge mounted to said drum surface to lay in the circumferential direction of drum rotation.

3. The apparatus of claim 1 wherein the knife edge of said die describes a closed figure bounding an area of film panel which is separated from the remainder of the film panel as the knife edge contacts said anvil roll.

4. The apparatus of claim 1 wherein the knife edge of said die is serrated so as to provide a line of perforations in the film panel as it passes between said die and said anvil roll.

5. The apparatus of claim 1 wherein said anvil roll includes resilient elastomer drive rings mounted around the periphery of said roll adjacent to the ends thereof and which are in rolling contact with the surface of said drum to drive said anvil roll along with the surface of said drum, said resilient drive rings normally spacing the surface of said anvil roll away from the surface of said drum but in position to make firm rolling contact with the knife edge of said die.

6. The apparatus of claim 2 wherein said means for mounting said anvil roll includes a mounting frame, pivot arms pivotally mounted to said mounting frame and mounting said anvil roll for rotation between them at one end, and an air pressure driven drive cylinder mounted to said mounting frame and having the drive rod thereof connected to said pivot arms, said air cylinder being operable to drive said anvil roll into and out of contact with said vacuum drum surface.

7. The apparatus of claim 2 wherein said anvil roll has a hardened steel surface.

8. A method of slitting a pattern into panels of plastic film and applying such panels to carton blanks, comprising the steps of:

(a) providing a rotating cylindrical surfaced drum having vacuum applied to perforations distributed over the surface thereof;

(b) providing a knife edged cutting die mounted on and protruding above the surface of the drum which is adapted to cut individual film panels laid over the die in a pattern defined by the knife edge of the die;

(c) laying an individual panel of plastic film over the knife edged die to allow the film panel to rotate with the surface of the vacuum drum;

(d) pressing the film panel between the knife edged die and a hard surfaced anvil roll which rotates with the vacuum drum to cut the film panel therebetween in the pattern defined by the edge of the die; and (e) placing a carton blank having a glue applied thereto in a position to register with the individual film panel after the pattern has been cut therein and to have the same pressed upon the glued portions of the blank as the drum rotates into contact with the carton blank.

9. Film panel cutting apparatus comprising:

(a) a vacuum drum having a cylindrical surface with a plurality of perforations distributed over the surface, said vacuum drum being adapted such that vacuum draw pressure applied to the drum interior will provide a vacuum draw to the perforations on the surface of said drum;

(b) means for applying vacuum pressure to said drum to apply a vacuum draw to the perforations in said drum surface;

(c) a knife edged die mounted to and protruding above the surface of said drum;

(d) an anvil roll having a hard cylindrical surface;

(e) means for mounting said anvil roll for rotation with the surface of said vacuum drum and for urging said anvil roll toward said drum surface such that the surface of said anvil roll makes firm rolling contact with the knife edge of said knife edged die, whereby film panels fed to the surface of said drum to lie over said die will be held in position over the same by the vacuum draw applied to the perforations in the surface of said drum, and, as said drum rotates, the film panels will be cut at the knife edge of said die as the film panel is engaged between the knife edge of said die and said anvil roll; and (f) ramp shaped shims mounted to the surface of said drum in position to smoothly engage the surface of said anvil roll and elevate it to a position substantially at the height of the knife edge of said die to bring said anvil roll smoothly into contact with the knife edge of said die, the trailing edges of said ramp shaped shims being located substantially adjacent to the leading edge of said knife edged die and located on either side of the position of a film panel laid over said die.

10. Improved apparatus for mounting plastic film windows on cut-out carton blanks, of the type having a perforated surfaced vacuum drum, a film panel feeding station for laying film panels individually on the surface of the vacuum drum whereupon they are held to the drum surface by vacuum suction, a carton blank feeding conveyor which delivers adhesive coated carton blanks to a position adjacent the vacuum drum in registry with film panels on the vacuum drum, whereupon the film panels are released from the vacuum drum and remain adhered to the carton blank, the improvement comprising:

(a) a knife edged die mounted to and protruding above the surface of said drum;

(b) an anvil roll having a cylindrical surface;

(c) means for mounting said anvil roll for rotation with the surface of said vacuum drum and for urging said anvil roll toward said drum surface such that the surface of said anvil roll makes firm rolling contact with the knife edge of said knife edged die, whereby plastic film panels fed to the surface of said drum to lie over said die will be held firmly over the same by the vacuum suction applied to the perforations on said drum surface, and, as said drum rotates, the panels will be cut at the knife edge of said die as the film panel is engaged between said die and said anvil roll; and (a) ramp shaped shims mounted to the surface of said drum in position to smoothly engage the surface of said anvil roll and elevate it to a position substantially at the height of the knife edge of said die to bring said anvil roll smoothly into contact with the knife edge of said die, the trailing edges of said ramp shaped shims being located substantially adjacent to the leading edge of said knife edged die and located on either side of the position of a film panel laid over said die.

* * * * *